US005567041A

United States Patent [19]

Slocum

[11] Patent Number: 5,567,041

[45] Date of Patent: Oct. 22, 1996

[54] SELF SUPPORTING RECESSED CEILING FIXTURE

[76] Inventor: Karl Slocum, 21 Greenwood Ave., Trenton, N.J. 08611

[21] Appl. No.: 514,683

[22] Filed: Aug. 14, 1995

[51] Int. Cl.[6] ..... F21S 1/02

[52] U.S. Cl. ..... 362/148; 362/365; 362/375

[58] Field of Search ..... 362/147, 148, 362/149, 150, 364, 365, 366, 374, 375

[56] References Cited

U.S. PATENT DOCUMENTS

| | | | |
|---|---|---|---|
| 3,316,399 | 4/1967 | Totten | 362/364 |
| 3,652,847 | 3/1972 | McFarlin | 362/277 |
| 4,930,054 | 5/1990 | Krebs | 362/149 |
| 5,314,148 | 5/1994 | Jones | 362/365 |

*Primary Examiner*—Denise Gromada
*Assistant Examiner*—Alan B. Cariaso

[57] ABSTRACT

A self supporting recessed ceiling fixture including a can formed of an exterior cylinder with four spring clips attached thereto and an interior cylinder. The exterior cylinder has an interior surface, an exterior surface and a bottom edge with a bottom opening adjacent thereto. Each spring clips are capable of movement between the interior and exterior surface of the exterior cylinder. The exterior cylinder is positioned within a hole of a ceiling. The spring clips support the exterior cylinder within the hole of the ceiling. The interior cylinder is positioned within the exterior cylinder in the ceiling and supported by three supporting spokes. Included is a bulb support formed of four sections. The bulb support is positioned within the interior cylinder. A diffusing lens is provided. Lastly, a support ring for positioning within the exterior cylinder is included. The support ring supports the lens within the can positioned through the ceiling.

10 Claims, 3 Drawing Sheets

SELF SUPPORTING RECESSED CEILING FIXTURE

BACKGROUND OF THE INVENTION

1. Field of the Invention

The present invention relates to a self supporting recessed ceiling fixture and more particularly pertains to allowing a light fixture to be places recessed in the hole of a ceiling without framing to the ceiling and further allowing the recessed light fixture to be supported by spring clips coupled to the exterior of the fixture.

2. Description of the Prior Art

The use of ceiling light fixtures is known in the prior art. More specifically, ceiling light fixtures heretofore devised and utilized for the purpose of being placed recessed in a ceiling are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,188,449 to Davis and Uryase discloses a lighting fixture assembly. U.S. Pat. No. 5,130,914 to Bengochea discloses a light fixture assembly. U.S. Pat. No. Des. 294,068 to Platner discloses ceiling light fixture. U.S. Pat. No. Des. 303,436 to Clyde-Mason discloses a ceiling light fixture. U.S. Pat. No. 4,044,246 to Mocimo and Richey discloses a ceiling mounted light fixture. Lastly, U.S. Pat. No. 3,652,847 to McFarlin discloses a recessed ceiling light fixture.

While these devices fulfill their respective, particular objectives and requirements, the aforementioned patents do not describe a self supporting recessed ceiling fixture that allows a light fixture to be inserted through any pre-cut hole in a ceiling and be supported thereon with retractable spring clips attached to the recessed light fixture.

In this respect, the self supporting recessed ceiling fixture according to the present invention substantially departs from the conventional concepts and designs of the prior art, and in doing so provides an apparatus primarily developed for the purpose of allowing a light fixture to be places recessed in the hole of a ceiling without framing to the ceiling and further allowing the recessed light fixture to be supported by spring clips coupled to the exterior of the fixture.

Therefore, it can be appreciated that there exists a continuing need for a new and improved self supporting recessed ceiling fixture which can be used for allowing a light fixture to be places recessed in the hole of a ceiling without framing to the ceiling and further allowing the recessed light fixture to be supported by spring clips coupled to the exterior of the fixture. In this regard, the present invention substantially fulfills this need.

SUMMARY OF THE INVENTION

In view of the foregoing disadvantages inherent in the known types of ceiling light fixtures now present in the prior art, the present invention provides an improved Self supporting recessed ceiling fixture. As such, the general purpose of the present invention, which will be described subsequently in greater detail, is to provide a new and improved self supporting recessed ceiling fixture and method which has all the advantages of the prior art and none of the disadvantages.

To attain this, the present invention essentially comprises, in combination a can. The can is formed of an exterior cylinder and an interior cylinder. The exterior cylinder has an exterior surface, interior surface, a top opening and a bottom edge with a bottom opening adjacent thereto. The exterior cylinder has four spring clips spaced apart and projecting from the exterior surface. Each spring clip is positioned about ½ inch above the bottom edge and attached along the interior surface with a pop rivet. Each clip further is capable of retractable movement between the interior and exterior surface of the exterior cylinder. The bottom edge has adjacent thereto a flange projecting outwardly therefrom. The flange has four generally rectangular slots spaced apart and positioned thereon. The exterior cylinder is capable of being positioned within a pre-cut hole of a ceiling. The spring clips are capable of retracting inward when the exterior cylinder slides pass a sheet rock portion of the ceiling. The spring clips further capable of retracting outward when the flange is flush with the ceiling for supporting the exterior cylinder within the ceiling. The interior cylinder has an inner wall, an outer wall and a base portion at a top end and an opening at a bottom end. The base portion has a receiving opening therethrough. The interior cylinder is sized for positioning within the exterior cylinder and spaced from the interior surface to leave an air flow area. Included are three supporting spokes having a Z-shape. Each supporting spoke is positionable in the air flow area between the interior cylinder and the exterior cylinder. Each spoke is capable of being attached to the interior surface of the exterior cylinder and the outer wall of the interior cylinder. Each support spoke is further capable of securing the interior cylinder within the exterior cylinder. A bulb support is provided. The support is formed of four cylindrical sections being collinear and coupled one section to another section. The sections comprising a connector, a housing, a fitter and a bulb receptacle. The connector is capable of receiving therein a power cord and being attached to the housing. The power cord has cord ends passing from the connector into the housing. The fitter is attached to the housing and the bulb receptacle. The bulb support is sized for positioning within the interior cylinder adjacent the inner wall. The bulb support, when positioned within the interior cylinder, allows the housing and the connector of the bulb support to project through the receiving opening and above the base portion of the interior cylinder. The bulb receptacle has internal threads for the threaded receipt of a light bulb therein. The light bulb is placed in the bulb support when the bulb support is positioned within the interior cylinder of the can. Included is a diffusing lens that has a conical portion and a cylindrical base with external threads. The lens is capable of diffusing light being emitted from the light bulb positioned within the bulb support when the bulb being within the bulb support of the can. Lastly, a cylindrical support ring is included. The support ring has internal machine threads and a securing bearing. The support ring is positioned within the air flow area between the exterior cylinder and the interior cylinder and adjacent the bottom edge. The securing bearing is positionable within a socket on the inner surface of the exterior cylinder for locking the support ring therein. The support ring further has four clip seats for positioning around a tip end of the spring clip when the ring is locked within the exterior cylinder. The machine threads of the ring are capable of coupling with the external threads of the base of the lens. The threads coupling allow the lens conical portion to be adjacent the flange. The support ring is locked within the exterior cylinder and is supported within the ceiling when the exterior cylinder of the can is supported with the spring clips within the ceiling.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved self supporting recessed ceiling fixture which has all of the advantages of the prior art ceiling light fixtures and none of the disadvantages.

It is another object of the present invention to provide a new and improved self supporting recessed ceiling fixture which may be easily and efficiently manufactured and marketed.

It is further object of the present invention to provide a new and improved self supporting recessed ceiling fixture which is of durable and reliable constructions.

An even further object of the present invention is to provide a new and improved self supporting recessed ceiling fixture which is susceptible of a low cost of manufacture with regard to both materials and labor, and which accordingly is then susceptible of low prices of sale to the consuming public, thereby making such self supporting recessed ceiling fixture economically available to the buying public.

Still yet another object of the present invention is to provide a new and improved self supporting recessed ceiling fixture which provides in the apparatuses and methods of the prior art some of the advantages thereof, while simultaneously overcoming some of the disadvantages normally associated therewith.

Even still another object of the present invention is to provide a self supporting recessed ceiling fixture for allowing a light fixture to be places recessed in the hole of a ceiling without framing to the ceiling and further allowing the recessed light fixture to be supported by spring clips coupled to the exterior of the fixture.

Lastly, it is an object of the present invention to provide a new and improved self supporting recessed ceiling fixture comprising a can. The can is formed of an exterior cylinder with four spring clips attached thereto and an interior cylinder. The exterior cylinder has an interior surface, an exterior surface, a top opening and a bottom edge with a bottom opening adjacent thereto. Each spring clips is capable of movement between the interior and exterior surface of the exterior cylinder. The exterior cylinder is capable of being positioned within a pre-cut hole of a ceiling. The spring clips are capable of supporting the exterior cylinder within the hole by clipping onto an interior surface of the ceiling when the exterior cylinder is position within the hole. The interior cylinder is sized for positioning within the exterior cylinder positioned within the hole of the ceiling. The interior cylinder is supported within the exterior cylinder by three supporting spokes. The supporting spokes are attached to the interior cylinder and the interior surface of the exterior cylinder. Included is a bulb support. The bulb support is formed of a connector, a housing, a fitter and a bulb receptacle. The bulb support is sized for positioning within the interior cylinder. The housing and the connector of the bulb support projects above the interior cylinder and beyond the top opening of the exterior cylinder. The fitter and the bulb receptacle are positioned within the interior cylinder. A diffusing lens is provided. The diffusing lens has external threads and is capable of being positioned within the bulb support. A support ring is included. The support ring has internal machine threads and a securing bearing. The ring is positionable within the exterior cylinder and exterior the interior cylinder. The securing bearing locks onto the interior surface of the exterior cylinder. The machine threads of the ring are capable of coupling the external threads to support the lens within the can is positioned through the ceiling.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
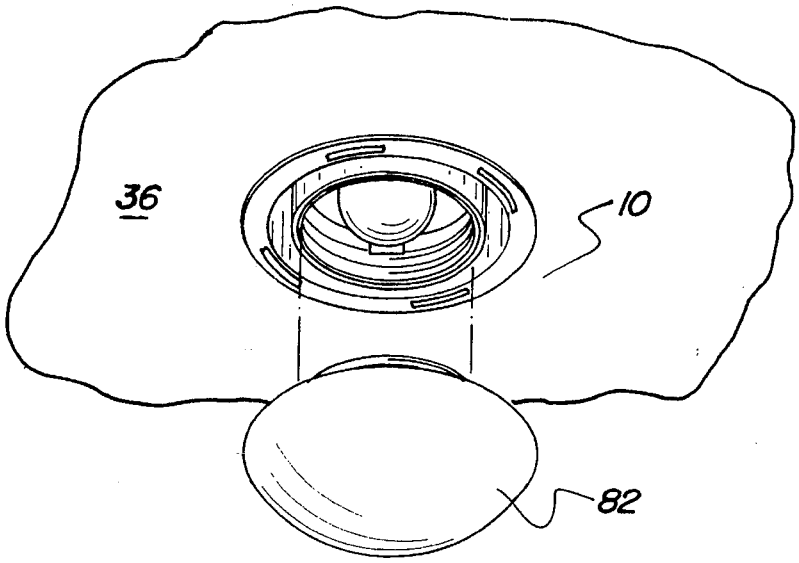
FIG. 1 is a perspective view of the preferred embodiment of the self supporting recessed ceiling fixture constructed in accordance with the principles of the present invention.

With reference now to the drawings, and in particular to FIG. 1 thereof, the preferred embodiment of the new and improved self supporting recessed ceiling fixture embodying the principles and concepts of the present invention and generally designated by the reference numeral 10 will be described.

The present invention, the self supporting recessed ceiling fixture 10 is comprised of a plurality of components. Such components in their broadest context include a can, a bulb support, a support ring and a lens. Such components are individually configured and correlated with respect to each other so as to attain the desired objective.

Figure 2:
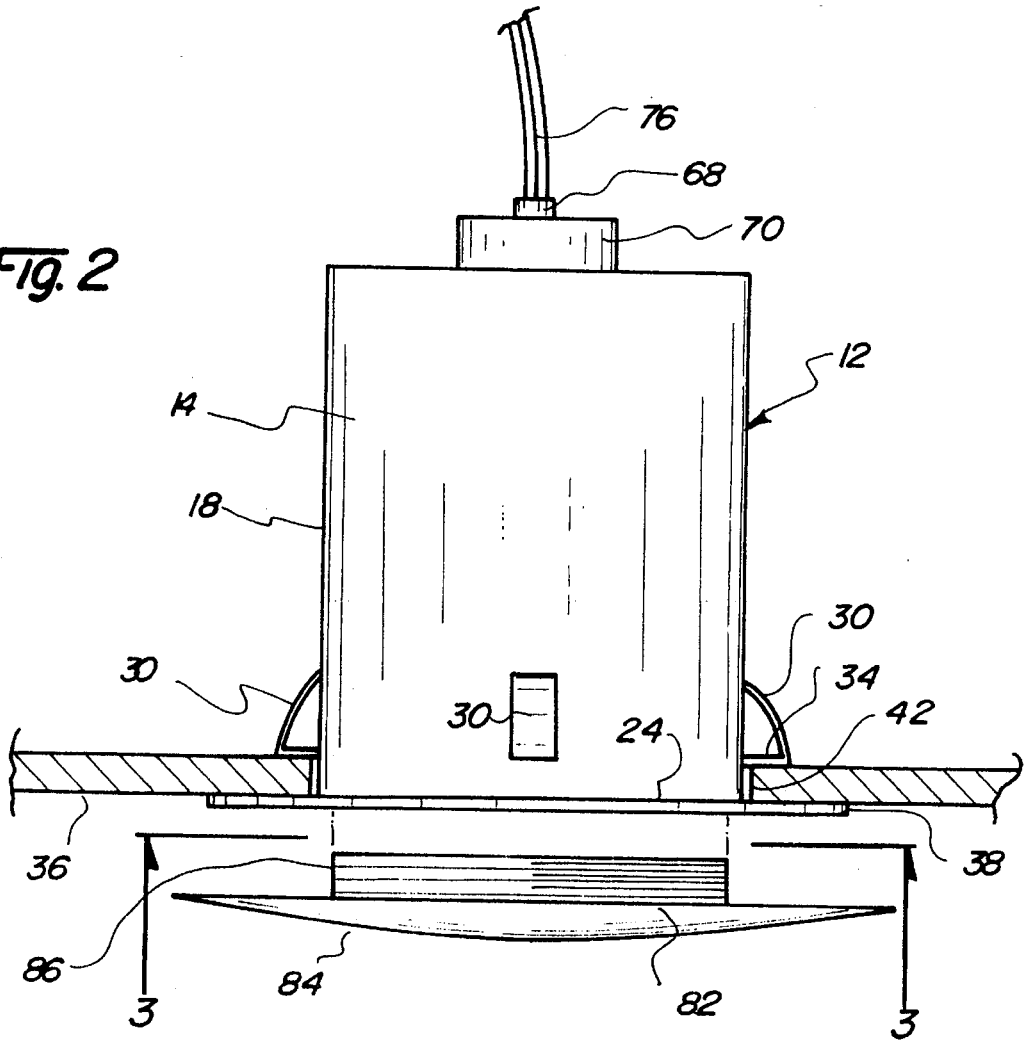
FIG. 2 is a side view of the preferred embodiment of the present invention in an operable configuration.
Figure 4:
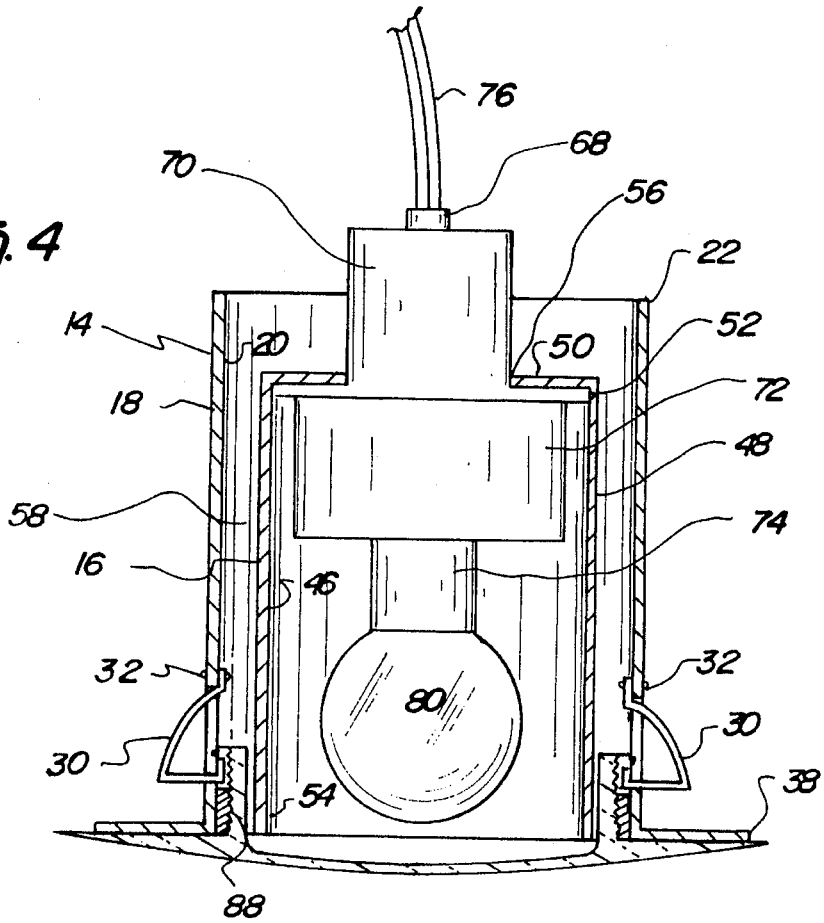
FIG. 4 is section view of the present invention along lines 4—4 of FIG. 3.
Figure 5:
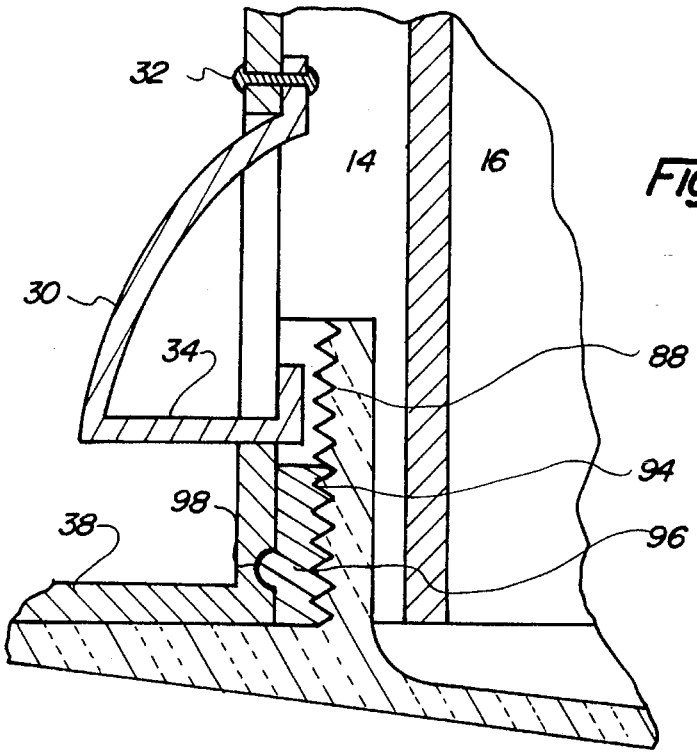
FIG. 5 is an enlarged view of the coupling of the various components of the present invention.

Specifically, the present invention includes a can 12, as shown in FIG. 2. The can is formed of an exterior cylinder 14 and an interior cylinder 16, as shown in FIG. 4. The exterior cylinder preferably is formed of steel. The interior cylinder is formed of aluminum. The exterior cylinder has an exterior surface 18, interior surface 20, a top opening 22 and a bottom edge 24 with a bottom opening 26 adjacent thereto. The exterior cylinder has four spring clips 30 spaced apart and projecting from the exterior surface. Each spring clip is positioned about ½ inch above the bottom edge and attached along the interior surface with a pop rivet 32. Each spring clip has a tip end 34. The space between the clip and the bottom edge is sized in order to accommodate the width of the sheet rock used for a ceiling 36 of FIG. 1. Each clip further is capable of retractable movement between the interior and exterior surface of the exterior cylinder.

Figure 3:
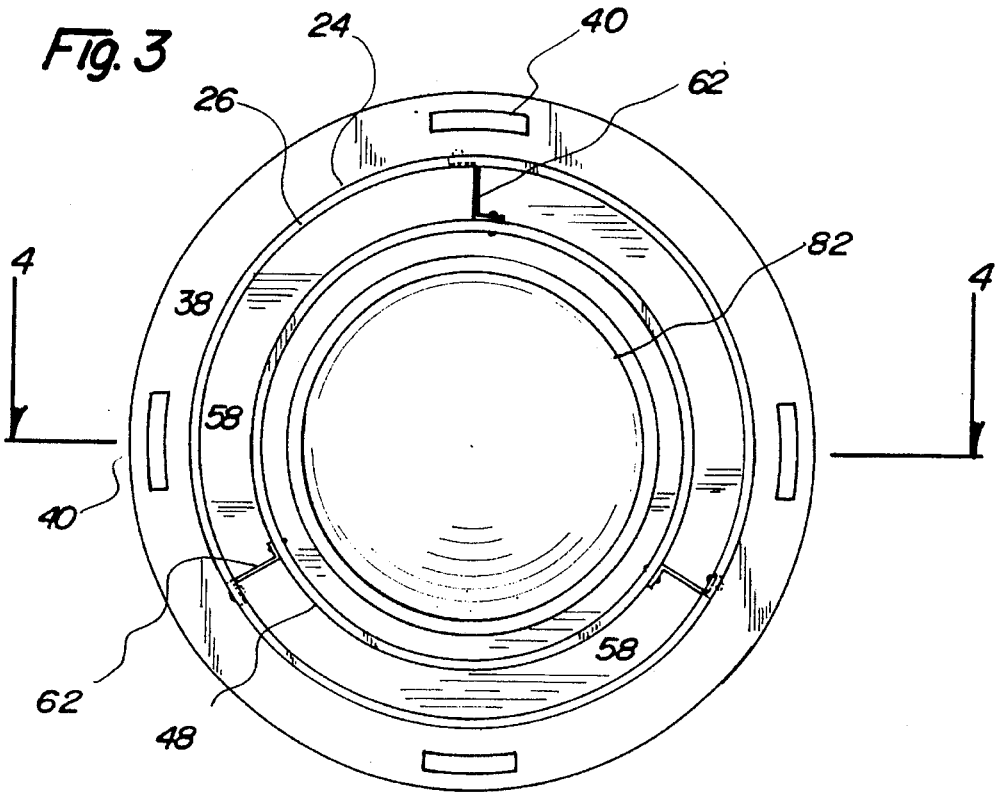
FIG. 3 is a bottom plan view of the preferred embodiment of the present invention.

The bottom edge 24 has adjacent thereto a flange 38 projecting outwardly therefrom. As best illustrated in FIG. 3, the flange has four generally rectangular slots 40 spaced apart and positioned thereon. The flange may be used to support the can if the electrical building code require less load on the ceiling. If this is the case than a screw may be placed through the slot of the flange to secure the can to a ceiling joist. The exterior cylinder is capable of being positioned within a pre-cut hole 42 of a ceiling. The spring clips is capable of retracting inward when the exterior cylinder slides pass a sheet rock portion of the ceiling 36. The spring clips further are capable of retracting outward when the flange is flush with the ceiling for supporting the exterior cylinder within the ceiling. As illustrated in FIG. 2, when the can is positioned in the hole the spring clips rest on the interior surface of the ceiling to support the can.

The interior cylinder has an inner wall 46, an outer wall 48 and a base portion 50 at a top end 52 and an opening at a bottom end 54. The base portion has a receiving opening 56 therethrough. The interior cylinder, as shown in FIG. 2, is sized for positioning within the exterior cylinder. The outer wall is spaced from the interior surface to leave an air flow area 58. The air flow area allows heat generated, when the light is on, to dissipate. The double wall construction, by creating the air flow area, is a safety feature.

As best illustrated in FIG. 3, three supporting spokes 62 that have a Z-shape are provided. The supporting spikes are formed of aluminum. The supporting spokes are positioned in the air flow area 58 between the interior cylinder 14 and the exterior cylinder 12. Each spoke is attached to the interior surface 20 of the exterior cylinder and the outer wall 48 of the interior cylinder, as shown in FIG. 2. Each support spoke further secures the interior cylinder within the exterior cylinder.

Figure 6:
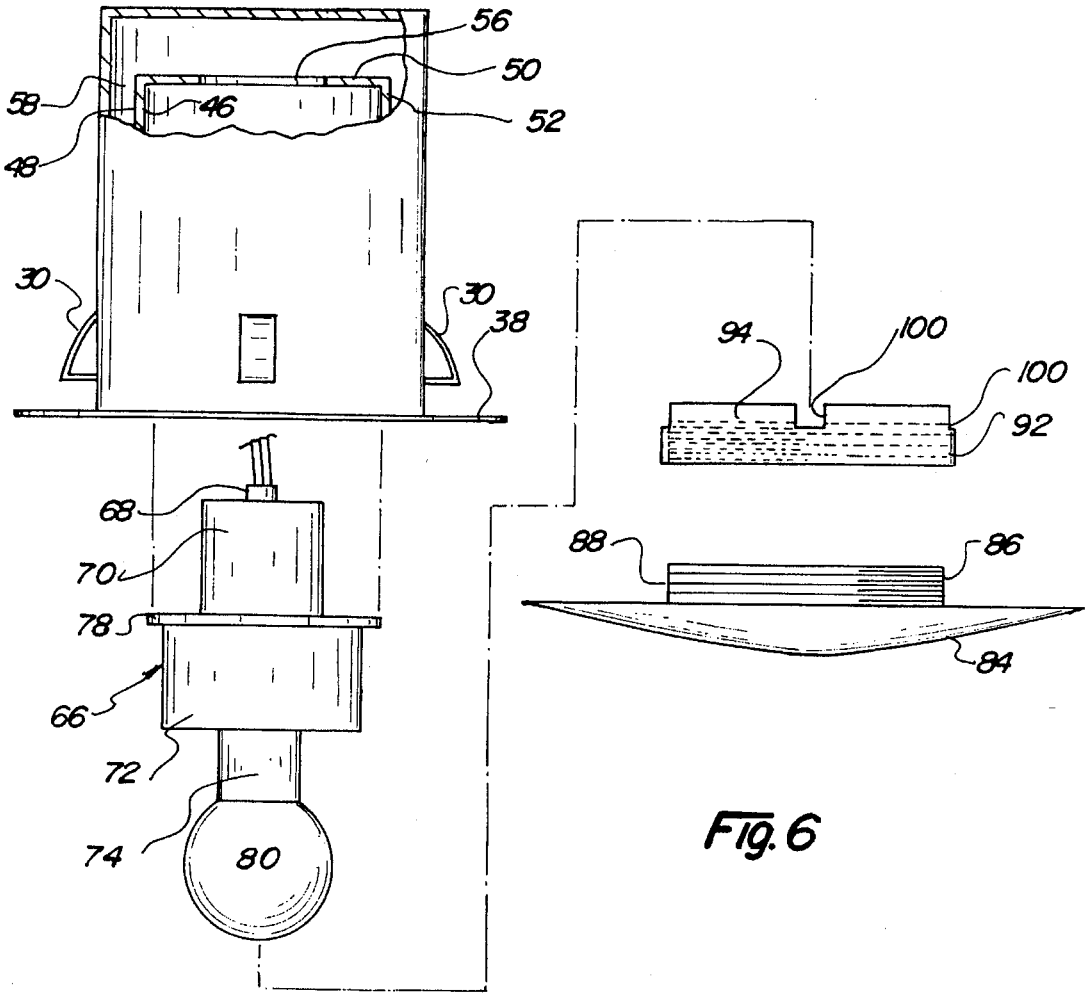
FIG. 6 is exploded view of the present invention with illustrating the placement of the various components.

Also included is a bulb support 66. The bulb support is formed of four cylindrical sections being collinear and coupled one section to another section. Each section of the bulb support of FIG. 6, is formed of a light weight metal or metal alloy and porcelain. The sections are comprised of a connector 68, a housing 70, a fitter 72 and a bulb receptacle 74. The connector is capable of receiving therein a power cord 76 and is attached to the housing. The power cord has cord ends passing from the connector into the housing. The fitter is attached to the housing and the bulb receptacle. The housing has a bottom flange 78 that is positioned below and adjacent the base portion of the interior cylinder, as shown in FIG. 4. The bottom flange allows the bulb support to be retained within the can 12. The bulb support is sized for positioning within the interior cylinder adjacent the inner wall 46. The housing and the connector, when the bulb support is in the interior cylinder, projects through the receiving opening 56 and above the base portion 50 of the interior cylinder. The bulb receptacle has internal threads for the threaded receipt of a light bulb 80 therein. The light bulb is placed in the bulb receptacle when the bulb support is positioned within the interior cylinder of the can.

A diffusing lens 82 is provided. The diffusing lens of FIG. 1 and 6 have a conical portion 84 and a cylindrical base 86 with external threads 88. The lens is capable of diffusing light being emitted from the light bulb positioned within the bulb support 66 in the can 12.

Lastly, a cylindrical support ring 92 is included. The ring has internal machine threads 94 and a securing bearing 96. The support ring of FIG. 6, is one piece cast aluminum. The support ring is positioned within the air flow area 58 between the exterior cylinder 14 and the interior cylinder 16 and adjacent the bottom edge 24. The securing bearing is positionable within a socket 98 on the inner surface of the exterior cylinder for locking the support ring therein.

The support ring further has four clip seats 100 for positioning around the tip end 34 of the spring clip when the ring is locked within the exterior cylinder. The machine threads 94 of the ring are capable of coupling with the external threads 88 of the base of the lens. Coupling of the threads of the lens and ring allow the lens conical portion to be adjacent the flange 38. The support ring is locked within the exterior cylinder 14 and is supported within the ceiling when the exterior cylinder of the can is support with the spring clips 30 within the ceiling.

The present invention is a self supporting recessed ceiling fixture that has spring clips on its exterior surface which enable it to be supported with out screws on a ceiling. The ceiling fixture is made for an exterior cylinder with spring clips, an interior cylinder, a bulb support and lens. The spring clips ensure support of the structure within a hole of the ceiling. The spring clips allow the fixture to be secured in the ceiling without framing to the ceiling The interior cylinder is attached to the exterior cylinder with supporting spokes. The supporting spokes are attached at a position above the spring clips and below the top end of the interior cylinder. The lens is supported to the structure by way of a support ring that couples with the exterior cylinder and the lens. The structure is installed after installation of sheetrock and other ceiling material. Because of this and because no framing is needed, time is saved when ceiling installation occurs.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A self supporting recessed ceiling fixture comprising, in combination:

a can formed of an exterior cylinder and an interior cylinder, the exterior cylinder having an exterior surface, interior surface, a top opening and a bottom edge with a bottom opening adjacent thereto, the exterior cylinder having four spring clips spaced apart and projecting from the exterior surface, each spring clip being positioned about ½ inch above the bottom edge and attached along the interior surface with a pop rivet, each clip further being capable of retractable movement between the interior and exterior surface of the exterior cylinder, the bottom edge having adjacent thereto a flange projecting outwardly therefrom, the flange having four generally rectangular slots spaced apart and positioned thereon, the exterior cylinder capable of being positioned within a pre-cut hole of a ceiling, the spring clips being capable of retracting inward when the exterior cylinder slides pass a sheet rock portion of the ceiling, the spring clips further capable of retracting outward when the flange is flush with the ceiling for supporting the exterior cylinder within the ceiling;

the interior cylinder having an inner wall, an outer wall and a base portion at a top end and an opening at a bottom end, the base portion having a receiving opening therethrough, the interior cylinder being sized for positioning within the exterior cylinder and spaced from the interior surface to leave an air flow area;

three supporting spokes having a Z-shape being positionable in the air flow area between the interior cylinder and the exterior cylinder, each spoke capable of being attached to the interior surface of the exterior cylinder and the outer wall of the interior cylinder, each support spoke further capable of securing the interior cylinder within the exterior cylinder;

a bulb support formed of four cylindrical sections being collinear and coupled one section to another section, the sections comprising a connector, a housing, a fitter and a bulb receptacle, the connector capable of receiving therein a power cord and being attached to the housing, the power cord having cord ends passing from the connector into the housing, the fitter being attached to the housing and the bulb receptacle, the bulb support being sized for positioning within the interior cylinder adjacent the inner wall, the bulb support being positioned within the interior cylinder having the housing and the connector projecting through the receiving opening and above the base portion of the interior cylinder, the bulb receptacle having internal threads for the threaded receipt of a light bulb therein when the bulb support being positioned within the interior cylinder of the can;

a diffusing lens having a conical portion and a cylindrical base with external threads, the lens being capable of diffusing light being emitted from the light bulb positioned within the bulb when the bulb being within the bulb support of the can; and a cylindrical support ring having internal machine threads and a securing bearing, the support ring being positioned within the air flow area between the exterior cylinder and the interior cylinder and adjacent the bottom edge, the securing bearing positionable within a socket on the inner surface of the exterior cylinder for locking the support ring therein, the support ring further having four clip seats for positioning around a tip end of the spring clip when the ring being locked within the exterior cylinder, the machine threads of the ring capable of coupling with the external threads of the base of the lens allowing the lens conical portion to be adjacent the flange, the support ring being locked within the exterior cylinder and being supported within the ceiling when the exterior cylinder of the can being support with the spring clips within the ceiling.

2. A self supporting recessed ceiling fixture comprising:

a can formed of an exterior cylinder with four spring clips attached thereto and an interior cylinder, the exterior cylinder having an interior surface, an exterior surface, a top opening and a bottom edge with a bottom opening adjacent thereto, each spring clips being capable of movement between the interior and exterior surface of the exterior cylinder, the exterior cylinder capable of being positioned within a pre-cut hole of a ceiling, the spring clips being capable of supporting the exterior cylinder within the hole by clipping onto an interior surface of the ceiling when the exterior cylinder being position within the hole;

the interior cylinder being sized for positioning within the exterior cylinder being positioned within the hole of the ceiling, the interior cylinder being supported within the exterior cylinder by three supporting spokes, the supporting spokes being attached to the interior cylinder and the interior surface of the exterior cylinder, a bulb support formed of a connector, a housing, a fitter and a bulb receptacle and sized for positioning within the interior cylinder, the housing and the connector of the bulb support projecting above the interior cylinder and beyond the top opening of the exterior cylinder, the fitter and the bulb receptacle being positioned within the interior cylinder;

a diffusing lens having external threads and capable of being positioned within the bulb support; and a support ring having internal machine threads and a securing bearing, the ring being positionable within the exterior cylinder and exterior the interior cylinder with the securing bearing locking onto the interior surface of the exterior cylinder, the machine threads of the ring capable of coupling the external threads to support the lens within the can positioned through the ceiling.

3. The self supporting recessed ceiling fixture as set forth in claim 2 wherein the four spring clips being spaced apart and projecting from the exterior surface, each spring clip being attached to exterior cylinder with a pop rivet and having a end tab being about ½ inch above the bottom edge, each spring clip further being capable of inward and outward retractable movement when the exterior cylinder being pressed through the hole of the ceiling.

4. The self supporting recessed ceiling fixture as set forth in claim 2 wherein the bottom edge having a flange adjacent thereto and projecting outwardly, the flange being flush with the ceiling when the exterior cylinder being supported therein.

5. The self supporting recessed ceiling fixture as set forth in claim 2 wherein the interior cylinder having an inner wall, an outer wall, a top end and a bottom end, the top end having integral thereto a base portion with a receiving opening therethrough, the receiving opening capable of having positioned therethrough the connector and housing sections of the bulb support, the outer wall of the interior cylinder forming an air flow area therebetween the interior cylinder and the interior surface of the exterior cylinder.

6. The self supporting recessed ceiling fixture as set forth in claim 5 wherein the three supporting spokes having a Z-shape being positioned within the air flow area.

7. The self supporting recessed ceiling fixture as set forth in claim 2 wherein the bulb support having internal threads capable of threaded receipt a light bulb therein, and the connector of bulb support capable of receiving a power cord therein, the power cord having cord ends passing from the connector into the housing.

8. The self supporting recessed ceiling fixture as set forth in claim 2 wherein the diffusing lens having a threaded base and a conical portion, the conical portion being adjacent the flange of the exterior cylinder when the threaded base engages the machine threads of the supporting ring positioned within the can.

9. The self supporting recessed ceiling fixture as set forth in claim 2 wherein the support ring being cylindrical and positioned adjacent the bottom edge of the exterior cylinder along the interior surface, the ring further having four clip seats capable of having positioned therein a tip end of the spring clip.

10. The self supporting recessed ceiling fixture as set forth in claim 2 wherein the securing bearing of the support ring being locked in a socket of the inner surface.

* * * * *